United States Patent [19]

Pagnozzi et al.

[11] Patent Number: 4,734,995

[45] Date of Patent: Apr. 5, 1988

[54] VACUUM-DRYER FOR TIMBER

[76] Inventors: Vincenzo Pagnozzi, Strada Ponte Romano 1, Rocchetta di Cairo (Savona); Ernesto G. Pagnozzi, Campello sul Clitunno (Perugia), both of Italy

[21] Appl. No.: 786,977

[22] Filed: Oct. 15, 1985

[30] Foreign Application Priority Data

Oct. 15, 1984 [IT] Italy ..... 68016 A/84

[51] Int. Cl.[4] ..... F26B 3/20; F26B 9/04

[52] U.S. Cl. ..... 34/16.5; 34/92; 34/70; 34/143

[58] Field of Search ..... 34/16.5, 143, 92, 70

[56] References Cited

U.S. PATENT DOCUMENTS

| | | | |
|---|---|---|---|
| 3,064,363 | 11/1962 | Ikeuchi | 34/144 |
| 3,118,742 | 1/1964 | McNair Dalgeish | 34/143 |
| 3,149,929 | 9/1964 | Asplund | 34/16.5 |
| 3,574,949 | 4/1971 | Farnsworth | 34/143 |
| 4,466,198 | 8/1984 | Doll | 34/92 |
| 4,565,067 | 1/1986 | Tani | 60/547.1 |

*Primary Examiner*—Larry I. Schwartz

*Attorney, Agent, or Firm*—Sughrue, Mion, Zinn, Macpeak and Seas

[57] ABSTRACT

Vacuum dryer for sawn timber, in which at least one wall of a pair of opposing walls of the drying chamber for containing the timber is substantially rigid and flat while the opposing wall is sealingly movable towards the rigid wall under the pressure which acts on the exterior when the chamber is evacuated, so as to press the timber forcibly against the flat wall.

5 Claims, 2 Drawing Sheets

VACUUM-DRYER FOR TIMBER

The present invention relates to vacuum dryers for sawn timber.

The main object of the present invention is to provide a dryer of aforesaid type in which the evacuating action, which at present is used solely to cause the evaporation of the water in the timber, is also used for its secondary effects to bring considerable advantages to the drying process carried out by the dryer of the invention.

In particular, according to the invention, one secondary effect of the evacuating action will be directed advantageously to providing protection against the defects of warping and deformation of the timber, which are accepted as inevitable in any type of artificial drying just as they are in the natural process (seasoning), albeit to a lesser extent in the latter. Another object of the present invention is to provide a vacuum dryer in which the rate of drying is increased as a consequence of a secondary action of the vacuum which is suitably controlled according to the invention.

In order to achieve these and other objects which will become apparent from the following description, the present invention provides a vacuum dryer for sawn timber, the main characteristic of which lies in the fact that at least one of a pair of opposing walls of the chamber for containing the timber is substantially rigid and flat while the opposing wall is sealingly movable towards the rigid wall under the pressure which acts on the exterior when the chamber is evacuated, so as to press the timber against the rigid wall.

Further characteristics and advantages of the invention will become apparent from the detailed description which follows with reference to the appended drawings, provided purely by way of non-limiting example, in which.

Figure 1:
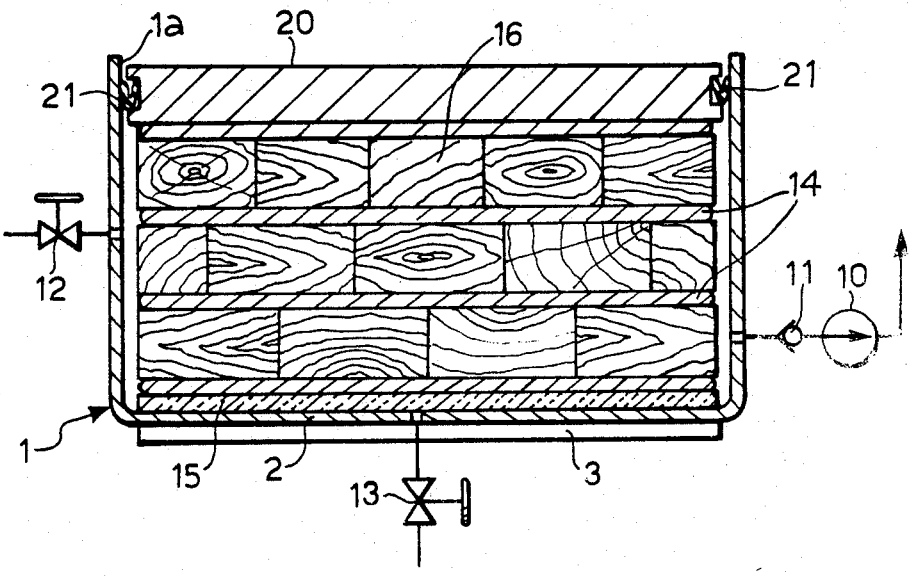
FIG. 1 is a section of a first embodiment.
Figure 2:
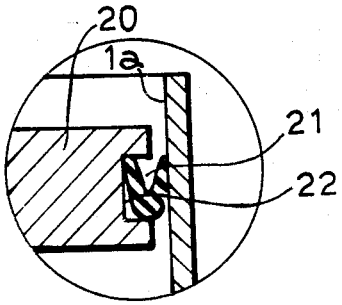
FIG. 2 illustrates a detail of FIG. 1 on an enlarged scale.

With reference to FIG. 1, a drying chamber, indicated 1, is made of sheet metal in a parallepipedal form with a rectangular plan and has a base wall 2 which is flat and reinforced by strong cross members 3 which make it substantially rigid.

The chamber 1 has an upper loading aperture 1*a* within which is slidable a rigid plate or wall 20 that closes the opposite side of the chamber 1 from the base wall 2. Around its periphery, the plate 20 has sealing means whose function will be explained below and which, in the embodiment illustrated, are constituted by a peripheral seal 21 housed in a peripheral groove 22 in the lateral edge of the plate 20. A vacuum pump, schematically indicated 10, has its intake side connected pneumatically to the chamber 1 by means of a one-way valve 11, while its delivery side is open to the exterior for connection to a vapour exhaust flue.

Other accessories of the assembly illustrated in the drawing are a manually operable valve 12 mounted on a side wall to allow air into the chamber when it is open, and a manually-operable drain valve 13 located in the bottom of the chamber 1 for discharging vapour condensation products to the exterior.

Several flat thermostatically-controlled flat heating elements of known type, constituted by plates which can be heated by electrical resistances or the circulation of hot fluid, are indicated 14.

The flat heating elements 14 are rectangular and each has a surface substantially equal to the surface of the bottom 2.

The lower flat heating element rests on the bottom 2 with the interposition of a layer of thermally insulating material 15 to avoid the dispersion of heat to the exterior.

The timber 16, which is sawn into planks, is interposed in known manner between the flat heating elements 14.

During operation, the flat heating elements transmit the heat needed to evaporate the water in the timber to the planks by contact, while the effect of the vacuum causes the water to evaporate at a lower temperature than in drying systems which operate at atmospheric pressure; at the same time, movement of water from the centre of the wood to the periphery is stimulated by known techniques.

With reference to the embodiment of the dryer of the invention illustrated in FIG. 1, the evacuating action causes the plate 20 to move into the chamber towards the opposite base wall 2 as a result of the atmospheric pressure acting from the exterior; the seal 21 ensures the movement of the plate 20 by keeping the chamber 1 hermetically sealed from the exterior. Thus, the timber planks between the heating elements are pressed firmly and uniformly against the flat wall 2. For example, if the operation is carried out with a 90% vacuum, even in a small dryer with heating elements having a surface of 1 m×5 m, the force pressing the timber against the base wall is 45,000 kg, a force which would be complicated to achieve with weights placed on the pile of timber when it is wished to limit deformation.

This large uniform pressure on the the timber, produced by the vacuum during the drying process, has the final effect of substantially eliminating warping and deformation of the timber, which remains perfectly flat.

Furthermore, in the continuous vacuum drying process of the invention, in which the heating and the vacuum act simultaneously, the pressure favours intimate contact between the flat heating elements and the wooden planks whereby the transmission of heat to the timber is considerably facilitated with the favourable result of accelerating the heating of the timber and hence, by definition, increasing the rate of drying. At the same time, heat losses to the exterior are reduced both because the heat is induced to pass more easily into the timber by the intimate contact with the flat heating elements and because of the shorter drying time.

By way of example, in various tests carried out on resinous timber species, such as Scots pine from Liguria, average hourly losses of up to 6% were obtained in passing from the maximum humidity of freshly sawn timber (up to 130% initial humidity) to the substantially anhydrous state. What is more important is that the operating temperature was kept lower than that usually used for resinous species, that is about 65° C., with the result that the natural colour of the timber was preserved and other defects were completely absent.

It should be noted that this average hourly loss, which is so considerable, cannot even be achieved with conventional dryers at temperatures as high as 180° C. The explanation for this phenomenon lies in the fact that the timber in the dryer according to the invention is squeezed as a result of the compression which produces a synergic effect in combination with the vacuum action: but we will return to this effect below.

In order to demonstrate the considerable reduction in energy consumption, even with timber species of average hardness, the results of one of the tests made with 75 mm thick elm are given.

In this test, in order to pass from an initial average humidity of 91% to 30% (saturation point of the fibres), only 1.155 kWh are expended to evaporate 1 kg of water, that is 994 cal. per liter of water evaporated. This consumption is extraordinarily small for a hard wood species of considerable thickness, as in the example cited above, and is even less than consumptions achieved with the timber species which are easier to dry, such as resinous species and thinner timber, in good conventional dryers with ventilation and energy recovery.

It is also pointed out that another object which can be achieved with the dryer of the invention is that of its use of reversing the technique usually used in bending the timber to correct warping and deformation defects already established in the timber due both to the effect of natural seasoning and the incorrect carrying out of artificial drying. It is in fact necessary to bring the timber to be straightened to the plasticization temperature with the use of the flat heating elements and to keep it pressed against the base wall by means of the vacuum for several hours depending on the thickness of the timber; after the heating of the flat heating elements has been stopped, the vacuum is maintained until the timber has been cooled to cause the stiffening of the timber while it is pressed against the base wall, thus establishing the desired flat form. A further object is that of increasing the squeezing action on the timber which has been mentioned above.

This is achieved by a reduction in the extent of the surface of each layer of timber interposed between the heating elements. Thus, the force produced by the low pressure on the plate 20 is transmitted to a smaller surface of each layer of timber, so that the pressure increases in inverse proportion to the decrease in surface area. Pressures as great as desired can be achieved by the reduction of the surface of the timber layers and the sacrifice of the capacity of the chamber for containing the timber. This sacrifice is amply repaid, however, since the rate of drying increases by a substantially quadratic law with the increase in pressure, thus giving an increase in the drying productivity at the end. Thus, for example, a halving of the holding capacity quadruples the drying rate with the end result that the productivity will be doubled. For practical purposes, it is not convenient to exceed a pressure of 2 kg/cm$^2$, in order to avoid the dried timber having a considerable increase in the variability of its thickness with variations in the ambient humidity.

The structure of the dryer in which it is wished systematically to increase the squashing action on the timber will be modified conveniently according to the invention, the surface of the heating elements being reduced in the construction phase.

The ratio of the measurement of the area of the heating elements to that of the plate 20 will be equal to the inverse of the value of the coefficient with which it is desired to increase the pressure on the timber relative to the pressure acting on the plate 20. Conveniently, this ratio will be ½, it being wished essentially to double the pressure on the timber.

In vacuum dryers with flat heating elements which use a discontinuous process, that is, one in which the heating phase occurs at atmospheric pressure while the vacuum phase follows the heating phase after the timber has reached the desired operating temperature, one can achieve similar compression results and even increased squashing of the timber against the flat wall by carrying out the heating under a vacuum which is relatively low but sufficient to achieve the pressure on the timber. However, in vacuum dryers which do not make use of flat thermostatically-controlled elements for heating the timber but use ventilation with hot air flows for heating, similar results to those described may be achieved by the placing of each layer of timber between two metal plates in direct contact with the timber and kept in place by the fillets used for spacing the timber layers in order to achieve the ventilation.

Figure 3:
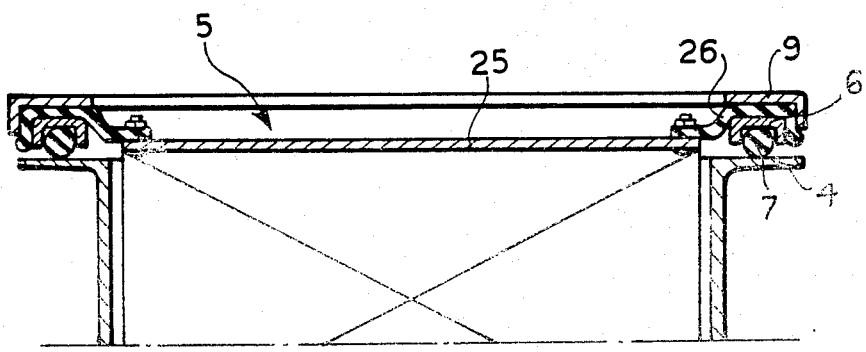
FIG. 3 is a section of a second embodiment.
Figure 4:
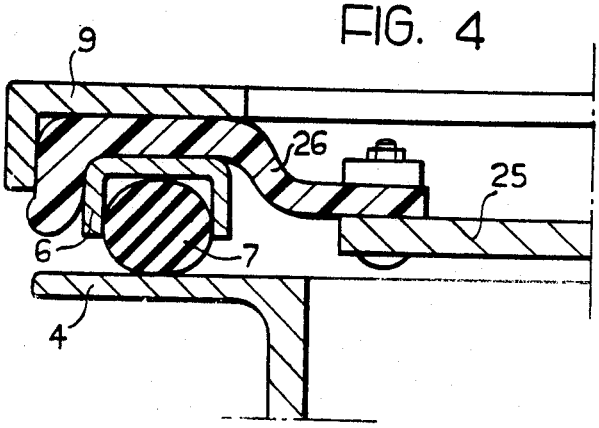
FIG. 4 illustrates a detail of FIG. 3 on an enlarged scale.

In correspondence with the loading aperture 1*a* of the embodiment of FIG. 3, the chamber 1 has a flat outwardly-turned flange 4 the plane of which is parallel to the base wall 2.

The aperture of the chamber 1 has an openable lid 5 formed by a rigid, rectangular peripheral frame 6 cooperating with the flange 4. The frame 6 is constituted by a channel section with downwardly-facing walls and a seal 7 of elastomeric material is inserted therein and abuts the flange 4.

A rigid plate, indicated 25, is disposed in the space defined by the rectangular peripheral frame 6 with its sides facing the corresponding sides of the frame 6 and equidistant therefrom. The edge of the plate 25 is connected to the frame 6 by a flat annular seal 26 of elastomeric material so as to ensure hermetic sealing between the plate 25 and the frame 6. The seal 26 allows the plate 25 to move towards the base wall 2 of the chamber when the latter is evacuated.

Figure 5:
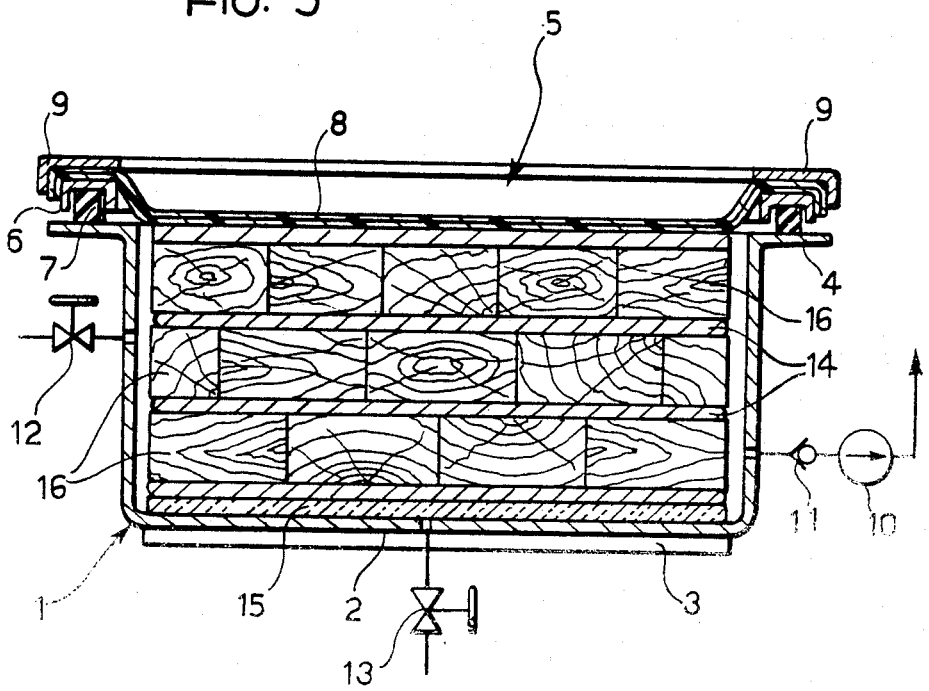
FIG. 5 is a section of a third embodiment.

The embodiment of FIG. 5 differs from that of FIG. 3 essentially in that the wall which is movable as a result of the vacuum created in the chamber is constituted by a thin, fabric-reinforced rubber sheet 8 with a thickness of several millimetres (or like elastomeric material), which is fixed peripherally to the frame 6 by pinching between the frame 6 and a counter-frame 9 to which it is fixed by screws in a known manner such as to effect a hermetic seal between the frame and counter-frame.

Again in this case, it is possible to use flat thermostatically-controlled elements with reduced surfaces to achieve greater pressure on the timber. In order to allow the pressure to be transmitted correctly, however, it is necessary for the upper thermostatically-controlled element adjacent the sheet 8 to have substantially the same extent as the sheet 8 and to be formed with sufficient rigidity. Alternatively, it is necessary to interpose a non-deformable layer, preferably of thermally insulating material, between the upper heating element and the sheet 8. This layer must have a surface substantially equal to that of the sheet 8 to provide a bearing for the sheet itself when it moves into the chamber under the action of the vacuum.

The principle of the invention remaining the same, the constructional details and embodiments may be varied widely without thereby departing from the scope of the present invention. Thus, for example, if it is also wished to obtain the same effect of compressing the timber in a direction perpendicular to that of the wall 2, it is necessary to provide the drying chamber with a second pair of walls similar and perpendicular to those of the preceding pair.

We claim:

1. A vacuum dryer for timber having a rigid structure including a drying chamber having a loading aperture for receiving a number of superimposed layers of timber planks and provided with a number of flat heating plates for causing evaporation of the water contained within the timber planks, each heating plate being interposed between two adjacent layers of timber planks and extending at least throughout the whole surface of the underlying layer of timber planks, said drying chamber having a flat and rigid base wall on which the stack of timber planks and interposed heating plates is placed, and a top wall comprised of a rigid plate slidably mounted within the loading aperture of the drying chamber and provided with peripheral sealing means whereby the top wall is sealingly moveable relative to the rigid structure of the dryer towards and away from said base wall, said dryer further comprising means for applying vacuum to the drying chamber so as to evacuate the evaporated water from the drying chamber while allowing at the same time said evaporation to be obtained at a relatively low temperature, said vacuum also causing said moveable wall to be pressed against the stack of timber planks and interposed heating plates, wherein each heating plate has a surface smaller than that of said moveable wall, to such an extent that the moveable wall creates a pressure onto the stack sufficient to insure an intimate contact between the timber planks and the heating plates, to avoid any deformation of the timber planks and to increase immigration of water from the timber planks through a squeezing action on said planks.

2. Vacuum dryer according to claim 1, characterised in that the rigid plate has a peripheral groove facing the walls of the aperture of the chamber, in which a seal is housed.

3. Vacuum dryer according to claim 1, characterised in that the rigid plate is contained in a surrounding frame with which it cooperates to form a cover for closing the loading aperture of the chamber, the peripheral edge of the plate being sealingly connected to the frame by a flat annular washer of elastomeric material which can allow the plate to move towards and away from the base wall under the action of the vacuum.

4. Vacuum dryer according to claim 1, characterised in that the ratio of the surface of the heating elements to that of the movable wall is $\frac{1}{2}$.

5. A method for drying timber, comprising the steps of:

stacking a number of layers of timber planks within a sealed chamber having a rigid flat base wall on which the stack of timber planks is placed and a top wall which is sealingly moveable towards and away from the base wall, interposing a flat heating plate between each pair of adjacent layers of timber planks, each heating plate extending at least throughout the whole surface of the underlying layer of timber planks, and activating said heating plates so as to cause evaporation of the water contained within the timber planks, while applying vacuum to said chamber so as to evacuate the evaporated water from said chamber, allowing at the same time said evaporation to be obtained at a relatively low temperature, the applied vacuum also causing said moveable wall to be pressed against the stack of timber planks and interposed heating plates, each heating plate having a surface smaller than that of said moveable wall, so such an extent that the moveable wall creates a pressure onto the stack sufficient to insure an intimate contact between the timber planks and the heating plates, to avoid any deformation of the timber planks and to increase migration of water from the timber planks through a squeezing action on said planks.

* * * * *